United States Patent [19]

Caton

[11] 4,228,746

[45] Oct. 21, 1980

[54] CONVENIENCE LOCKBOX

[75] Inventor: Myron A. Caton, Mission Hills, Calif.

[73] Assignee: Coxwells, Incorporated, Los Angeles, Calif.

[21] Appl. No.: 936,313

[22] Filed: Aug. 23, 1978

[51] Int. Cl.[3] ..... E05G 1/04

[52] U.S. Cl. ..... 109/59 T; 70/121; 70/168; 109/64

[58] Field of Search ..... 109/50, 58, 59, 64, 109/77; 70/168, 121, 123; 292/48

[56] References Cited

U.S. PATENT DOCUMENTS 1,173,068 2/1916 von Philp ..... 70/121

*Primary Examiner*—David H. Corbin

*Attorney, Agent, or Firm*—Nilsson, Robbins, Dalgarn, Berliner, Carson & Wurst

[57] ABSTRACT

A lockbox is disclosed, as for use in hotel closets, which includes an above-floor container fixed to define a space with a rectangular opening for closure by a locking cover. The cover incorporates a peripheral double ridge defining a peripheral channel to receive the upper edges of the container. Pairs of latching cam members are pivotally affixed at central, diametrically opposed locations in the cover, for actuation by a centrally located lock movement for engagement and disengagement with slots in the container. The movement is accomplished through a symmetrical linkage mechanism which simultaneously actuates each of the individual cam members and which incorporates a pair of parallel arms extending between pairs of the cam members and a pair of linking arms extending from the parallel arms to the lock movement. The pivotal support shafts for the cam members also serve as spacer mounts to support an internal cover for the locking mechanism.

1 Claim, 3 Drawing Figures

FIG. 1.
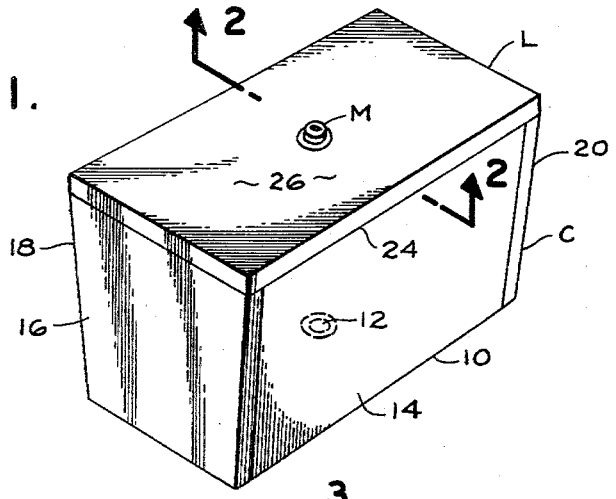
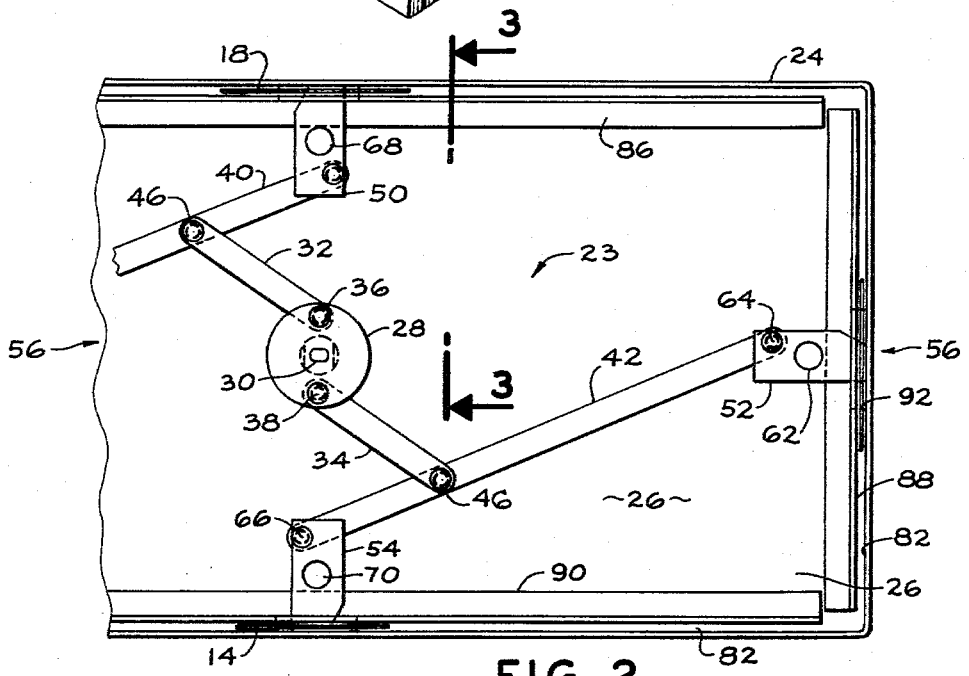
FIG. 2.
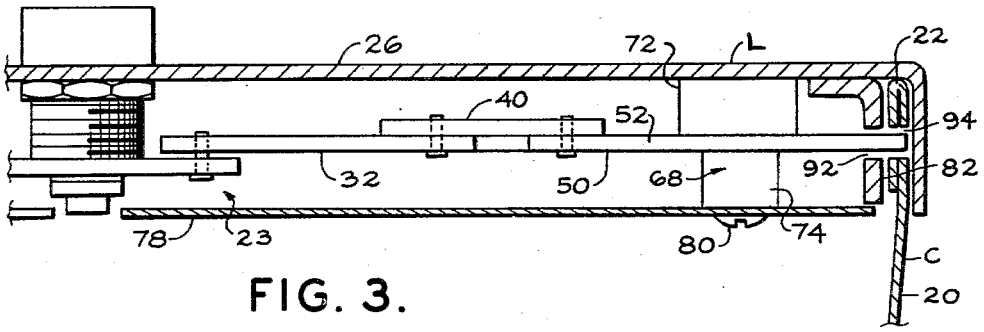
FIG. 3.

CONVENIENCE LOCKBOX

BACKGROUND AND SUMMARY OF THE INVENTION

In the construction of safes or lockboxes, a compromise is usually made between the cost of construction and the degree of security. That is, the cost of a unit is somewhat proportional to its effective security which is in turn related to the time and quality of equipment required to penetrate the interior of the unit. In general, the present invention involves an improved lockbox which is relatively inexpensive to manufacture and affords a high degree of security in view of such manufacturing cost.

The need frequently arises for a lockbox to contain semi-valuables in locations of limited access. As a specific example, a need exists for a secure place in a hotel or motel room, in which to store such items as cameras, binoculars, and other semi-valuables during periods when a guest is either sleeping or out of the room. In view of the economics of such an application, a practical lockbox must be relatively inexpensive to manufacture and install and should present a substantial obstacle to penetration by persons without sophisticated equipment, substantial working time, or making considerable noise.

In general, hotel thefts are accomplished by people who work quietly, with minimal equipment and have short access times to the hotel rooms. Accordingly, a lockbox constructed in accordance with the present invention is effective in many circumstances to deter theft, yet it is relatively inexpensive to install, affords convenient use, and does not detract from the comfort or appearance of the room.

In general, the lockbox of the present invention includes a downwardly tapered box or container which may be affixed to a room floor, as in the closet of a hotel room. Persons desiring to use the lockbox are issued a standarized cover incorporating a locking movement which may be operated by a unique key. The cover closes the container with a plurality of latching cam members actuated by a linkage mechanism that is actuated to be positioned variously through the locking movement. The structural arrangement by which the cover engages the container effectively shields the locking mechanism from common forms of tampering which might otherwise enable access to the interior.

BRIEF DESCRIPTION OF THE DRAWINGS

In the drawings, which constitute a part of this specification, an exemplary embodiment demonstrating the various objectives and features hereof is set forth as follows:

FIG. 1 is a perspective view of a lockbox constructed in accordance with the present invention;

FIG. 2 is a fragmentary sectional view taken horizontally across the top of the structure of FIG. 1; and FIG. 3 is a vertical sectional view taken along the line 3—3 of FIG. 1.

DESCRIPTION OF THE ILLUSTRATIVE EMBODIMENT

As indicated above, a detailed illustrative embodiment of the invention is disclosed herein. However, lockboxes may be embodied in accordance with various forms, some of which may be detailed rather differently from the disclosed illustrative embodiment. Consequently, the specific structural and functional details disclosed herein are merely representative, yet in that regard they are deemed to provide the best embodiment for purposes of disclosure and to provide the basis for the claims herein which define the scope of the present invention.

Referring initially to FIG. 1, a lockbox is depicted incorporating a container C and a cover L. The cover L incorporates a lock movement M for engaging the cover L on the container C along all four sides. In one application, i.e. hotel room use, the container C may be affixed to the floor of a closet contiguous to the wall with the consequence that penetration during a relatively short access time using unsophisticated equipment and without substantial noise presents a considerable obstacle.

Considering the lockbox of FIG. 1 in somewhat greater detail, the container C incorporates a rectangular bottom 10 defining a central bore 12 through which a stud (not shown) may be set in the floor to fix the location of the lockbox.

The bottom 10 is joined to four trapezoidal walls 14, 16, 18, and 20 which extend upwardly and outwardly, providing a mild taper in the configuration of the container C. As illustrated, the panels forming the end walls 16 and 20 are turned to lap the side walls 14 and 18; these members are then joined, as by welding techniques.

Additional reinforcing strength is also provided at the upper edges of the container C by folds in the walls as illustrated in FIG. 3. Specifically, the upper edges of the walls 14, 16, 18, and 20 are folded to provide a continuous rectangular hem 22 (FIG. 3) extending coincident with the upper edges of the container C. The hem 22 defines slots which receive the latching members. As illustrated in FIG. 3, the the cover L is locked onto the container C by a mechanism 23 which is considered in greater detail below, primarily with reference to FIG. 2.

Referring to FIG. 1 for consideration of the cover L in greater detail, it is to be noted that the cover L has a depending peripheral rim or ridge 24 extending downwardly from a flat plate 26 to shield the upper edges of the container C. As indicated above, a lock movement M is centrally located in the plate 26 of the cover L. Of course, any of a variety of lock movements may be employed; however, in one embodiment, a unique barrel-key lock has been found to be effective.

The cover L is symmetrical with respect to a center line (not illustrated) extending either the length or width of the structure. Accordingly, in the interests of simplification, duplicate details are partly eliminated from this description. Specifically, the diametrically opposed portions of the locking mechanism in the cover L are identical and detailed treatment of each is accordingly deemed to be inappropriate.

Referring now to FIG. 2, the interior portion of the lock movement M is illustrated in part, along with the locking mechanism 23, to reveal a turn disk 28 which may be rotated on a central shaft 30 through a fragment of a revolution when the lock or movement is released by the insertion of a key (not shown). The disk 28 is affixed to a pair of similar, opposed arms 32 and 34 by a pair of pivot pins 36 and 38 respectively. The ends of the arms 32 and 34 that are remote from the disk 28 are in turn pivotally affixed to a pair of identical arms 40 and 42 by pins 46. The arms 40 and 42 serve to revolve the locking cams or latches for locking the cover L to the container C. Specifically, the arms 40 and 42 are each connected for actuating a pair of the latching cams as will now be described. A pair of identical cams 52 (one only shown) are located at diametrically opposed ends 56 of the cover L. The longer sections of the arms 40 and 42 are coupled to such cams 52. More specifically, the ends of the arm 42 are coupled to one pair of latching cams 52 and 54 by pivot pins 64 and 66, the cams 52 and 54 being rotationally mounted on shafts 68 and 70 respectively. Somewhat similarly, the arm 40 has its ends connected to the cams 50 and 52 (cams 52 being at opposed ends of the cover L) respectively by pivot pins similar to those described above. Thus, the arm 40 functions just as the arm 42 for moving the locking cams about bearing shafts.

The bearing shaft 68 is illustrated in FIG. 3 along with the cam 52, which structures are representative of the four similar members at each side of the cover L. Specifically with regard to the shaft 68, a section 72 of increased diameter is welded to the interior of the cover plate 26 while a section 74 (of reduced diameter) rotatively supports the associated locking cam, e.g. cam 52. In a dual function, the rotary shafts also serve as spacers for affixing a shield plate 78 at the interior of the cover L. Specifically, as illustrated with respect to the shaft 68, the section 74 is internally threaded to receive a stud 80 which passes through the plate 78. Accordingly, the plate 78 is affixed to the cover at the four diametrically opposed locations of the locking cams.

As a further shield for the locking mechanism in the cover L, and also to define a peripheral channel 82 (FIGS. 2 and 3) for receiving the edges of the container C, four lengths of angle extend in alignment with the edges of the cover L. Specifically, opposed lengths 86 and 90 (FIG. 2) of angle stock are affixed to the interior of the plate 26 in alignment with the sides of depending ridges of the cover L. Similarly, opposed lengths 88 are affixed in alignment at the ends of the cover L. Consequently, the rectangular channel 82 is defined to matingly receive the hem 22 of the container C. In that regard, the lengths, e.g. length 88, each define a slot 92 (FIG. 3) for passing one of the latching cams, e.g. cam 52, to be received in an aligned slot as 94 in the hem 22.

In producing the lockboxes of the present invention, traditional metal-working equipment and techniques can be employed. In that regard, welding is effective to accomplish joining in the structure. Of course, the heavier and more durable the alloys used, the more secure is the lockbox. However, it will generally be desirable in various embodiments to employ hardened steel for the locking cams, e.g. cam 52. It is a feature of the present invention that reducing these members to small pivotally actuated members accommodates the use of a very sturdy alloy for their production.

In using the lockboxes of the present invention, as in a hotel, the covers L may be produced with sufficient tolerances to fit any of a plurality of containers C. Accordingly, a room may be fitted with the security space of a lockbox for an appropriate charge or upon request by a guest. As a related consideration, it is also noteworthy that the symmetry of the cover L accommodates it being fitted on a container C oriented in either direction. Prior to such placement, the locking mechanism is first actuated to pivotally withdraw the latching cams, e.g. cam 52, from the positions indicated in FIG. 3 so that the upper edges defining the hem 22 may be received in the channel 82. Subsequently, the locking mechanism may be actuated by revolving the disk 28 (FIG. 2) to actuate the opposed pairs of latching cams through the linkage including the arms 32 and 34, along with 40 and 42, to rotate the cams to the positions illustrated (FIG. 2) so that the ends thereof dwell in locking engagement with slots 94 in the hem 22.

With the cover L locked in position on the container C, access to the enclosed space is not readily accomplished in a short time interval without exotic equipment. For example, efforts to force one of the walls, e.g. wall 14, inwardly are resisted by the upper edge of the wall at the hem 22 (FIG. 2) engaging the ridge of the length 90 with the result that a substantial force is accepted without yielding.

As for manipulation of the locking mechanism, the substantial enclosure thereof results in considerable difficulty in that regard. Furthermore, it is readily apparent that the enclosure of the lockbox as depicted in FIG. 1 does not afford any substantial access to prying or forcing tools which might otherwise be effective. Consequently, the lockbox of the present invention is quite resistant to being opened without a key to actuate the lock movement M. Of course, the lockbox may be constructed with various modifications depending upon the specific purpose, style, and application. For example, the metal gauge of component plates, as well as reinforcing sections, may be altered substantially depending upon individual needs. Such variations of the basic embodiment are apparent, and accordingly the scope hereof shall not be referenced to the disclosed embodiment but on the contrary shall be determined in accordance with the claims as set forth below.

What is claimed is:

1. A lock box comprising:

a container of four walls defining pairs of opposed horizontal edges in a rectangular configuration, said walls further defining horizontal slots at central locations contiguous the horizontal edges of said walls;

a cover defining an external ridge and further including lengths of angle stock to define an internal ridge aligned with said external ridge whereby said ridges mutually define a rectangular channel for receiving said container edges at the interior of said cover whereby said ridges cover said horizontal slots on either side of said walls;

a lock movement, centrally affixed in said cover to accommodate a rotary motion pattern;

pairs of cam members each including a stub shaft welded to said cover and a cam rotatively supported on said stub shaft and pivotally mounted contiguous to said internal ridge of said cover and unexposed at the exterior of said cover, for engaging said edges of said container by mating in said slots;

a linkage mechanism connecting said cam members to said lock movement for rotating said cam members to engage and disengage said container and including a first pair of arms each interconnecting one pair of said cam members and a second pair of arms interconnecting said lock movement to said first pair of arms whereby rotation of said lock movement rotates said cam members; and a shield extending parallel to said cover whereby said linkage mechanism is sandwiched therebetween.

* * * * *